US005374977A

United States Patent [19]

Shiina et al.

[11] Patent Number: 5,374,977

[45] Date of Patent: Dec. 20, 1994

[54] APPARATUS FOR DETECTING AND CONTROLLING A TONER RUN-OUT IN A DEVELOPING UNIT

[75] Inventors: Yoshio Shiina; Takayuki Sunaga; Toru Isosu; Makoto Kanno; Toru Ishikawa; Hideaki Miyata, all of Kanagawa, Japan

[73] Assignee: Fuji Xerox Co., Ltd., Tokyo, Japan

[21] Appl. No.: 106,782

[22] Filed: Aug. 16, 1993

Related U.S. Application Data

[63] Continuation of Ser. No. 832,155, Feb. 6, 1992, abandoned.

[30] Foreign Application Priority Data

Feb. 8, 1991 [JP] Japan ..... 3-037889

[51] Int. Cl.[5] ..... G03G 15/08

[52] U.S. Cl. ..... 355/206; 355/245

[58] Field of Search ..... 355/206, 209, 245, 246, 355/308, 203; 222/DIG. 1; 118/694

[56] References Cited

U.S. PATENT DOCUMENTS

| | | | |
|---|---|---|---|
| 4,647,185 | 3/1987 | Takeda et al. | 355/246 X |
| 4,682,874 | 7/1987 | Fantuzzo | 355/209 |
| 4,711,551 | 12/1987 | Fujio et al. | 355/206 |
| 4,952,976 | 8/1990 | Katoh et al. | 355/206 |
| 4,987,449 | 1/1991 | Katoh | 355/206 |

FOREIGN PATENT DOCUMENTS

| | | | |
|---|---|---|---|
| 54-160244 | 12/1979 | Japan | 355/206 |
| 56-148017 | 11/1981 | Japan | 355/205 |
| 58-132767 | 8/1983 | Japan | 355/205 |
| 60-213971 | 10/1985 | Japan | 355/203 |
| 61-110164 | 5/1986 | Japan | 355/246 |
| 62-80670 | 4/1987 | Japan | 355/206 |
| 1-91165 | 4/1989 | Japan | 355/206 |

*Primary Examiner*—Joan H. Pendegrass

*Attorney, Agent, or Firm*—Finnegan, Henderson, Farabow, Garrett & Dunner

[57] ABSTRACT

An apparatus for detecting and controlling a the exhaustion of toner in a developing unit of an image recording device which forms an electrostatic latent image on a latent image carrier by exposure in response to image signals and develops the electrostatic latent image to a toner image to be recorded. The apparatus includes a detection unit for detecting a presence or absence of toner in the developing unit under a condition that a power of the image recording equipment is turned on and an interlock is released, and a drive unit for driving the developing unit and the toner supplying mechanism for a predetermined period of time when the toner is exhausted as is detected by the detection unit, wherein the detection unit detects again a presence or absence of toner in the developing unit after the drive unit drives the developing unit and the toner supplying mechanism.

10 Claims, 6 Drawing Sheets

APPARATUS FOR DETECTING AND CONTROLLING A TONER RUN-OUT IN A DEVELOPING UNIT

This application is a continuation of application Ser. No. 07/832,155, filed Feb. 6, 1992, now abandoned.

BACKGROUND OF THE INVENTION

The present invention relates to an apparatus for detecting and controlling a toner run-out in a developing unit to be used in an image recording equipment such as a copying machine or the like.

Generally, copying machines are respectively equipped with a toner run-out detecting apparatus for detecting the presence or absence of toner in the developing unit and for indicating a run-out of toner when there remains no toner in the developing unit.

The above toner run-out detecting apparatus is adapted to immediately indicate the fact that there remains no toner when the toner in the developing unit has been used up. However, the conventional toner run-out detecting and controlling apparatus has erroneously indicated that the toner is deemed to still remain due to a pressure of a member for cleaning a sensing surface of a toner sensor which detects the presence or absence of the toner. Therefore, some types of copying machines, which are adapted to halt when a copying operation of a certain specified number of sheets is finished after detecting a run-out of toner, may not certainly halt when the copying of a specified number of sheets is finished after the toner run-out has been detected.

In case a new toner cartridge is installed while the toner run-out is detected, the toner is not immediately supplied from the toner cartridge and the toner run-out status is not released in some cases even though the machine is operated. This status takes place when the new toner cartridge is not shaked before it is mounted on the developing unit.

Therefore, when the new toner cartridge is mounted, the developing unit and the toner supplying unit should have been idle-driven for a certain period of time to ensure supplying of the toner. In addition, the conventional toner run-out detecting and controlling apparatus, which is adapted to stop the printing operation of the machine when the printing of a certain specified number of sheets is finished after the toner run-out status has been detected, requires a troublesome operation such as cancellation of the halting status of the machine after a new toner cartridge is mounted on the machine.

The primary object of the present invention made in view of the above problems is to provide an apparatus for detecting and controlling a toner run-out in a developing unit capable of preventing a faulty indication due to a cleaning member of the toner run-out detection sensor, ensuring positive halting of the machine after completion of the printing of a specified number of sheets after the toner run-out has been detected, allowing a new toner cartridge to certainly supply the toner to cancel the toner run-out status when it is mounted on the machine without shaking it in advance, and releasing the machine, which has halted since detection of the toner run-out, only with a toner supplying operation when the new toner cartridge is mounted on the machine, thus improving the operational efficiency of copying machines.

Another object of the present invention is to provide an apparatus for detecting and controlling a run-out of toner in a developing unit which is capable of normally falling and feeding the toner by unblocking the toner if it is blocked in the toner supply mechanism and does therefore not fall despite that the toner still remains in the toner supplying mechanism.

SUMMARY OF THE INVENTION

For the purpose of accomplishing the above objects, an apparatus according to the present invention for detecting and controlling a run-out of toner in a developing unit of an image recording equipment which forms an electrostatic latent image on a latent image carrier by exposure in response to image signals and develops the electrostatic latent image to a toner image with toner supplied from a toner supplying mechanism. An image forming device comprises a developing unit and guide means for supplying toner to the developing unit. The guide means contains detecting means for detecting a presence or absence of toner and toner conveying means for conveying toner to the developing unit.

A toner cartridge is mounted on the guide means, and has toner dispensing means for dispensing toner to the guide means. The detecting means detects a presence or absence of toner in the guide means according to the state of a power-on signal of the image forming device and the state of an interlock signal of the image forming device. Means are provided for driving the dispensing means for a predetermined period of time after an absence of toner is first detected until a presence or absence of toner is again detected in the guide means.

Means are provided for outputting a toner exhaustion signal when an absence of toner is detected a second time. Means are provided for accumulating a number of prints after the toner exhaustion signal is outputted and for shutting down the image forming device when the accumulated number of prints exceeds a predetermined value.

DETAILED DESCRIPTION OF THE PREFERRED EMBODIMENT

Hereinafter, an embodiment of the present invention will be described in detail with reference to the accompanying drawings.

Figure 4:
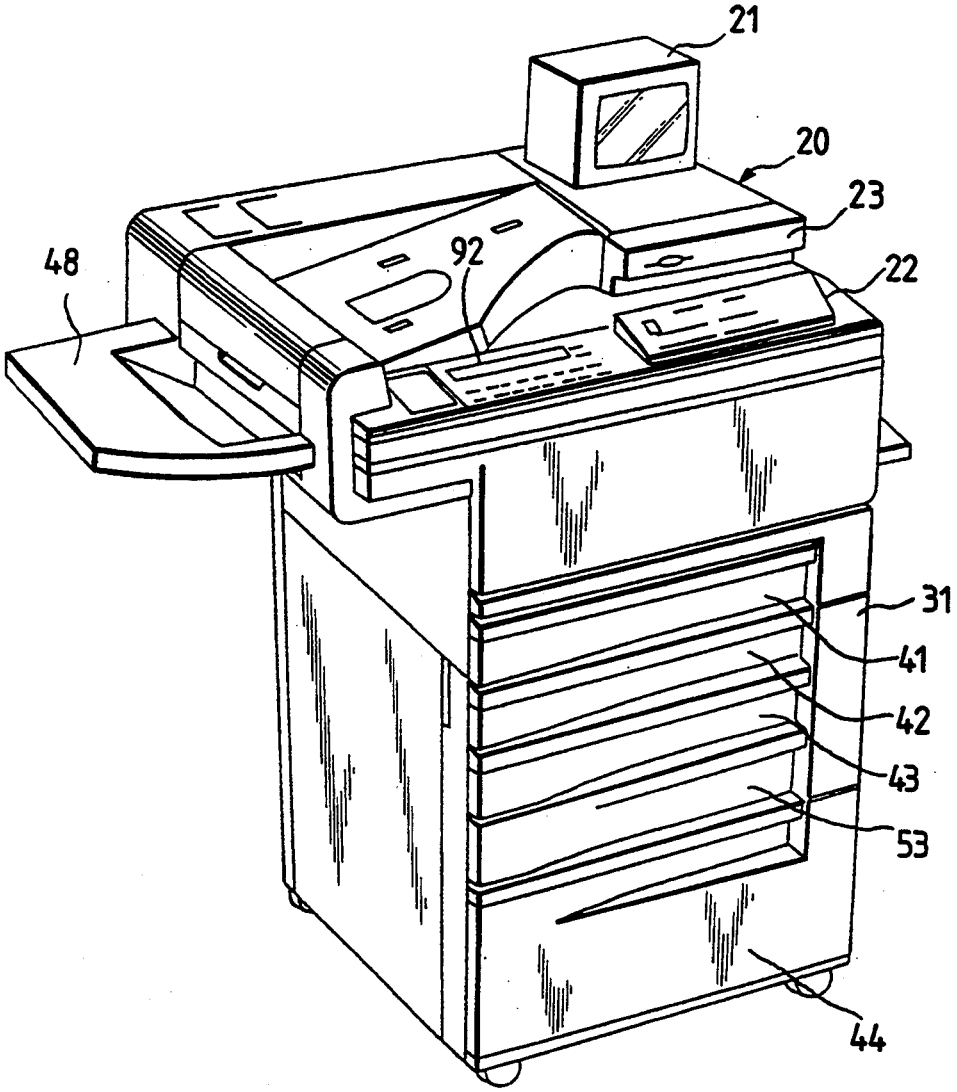
FIG. 4 is a perspective view showing the appearance of the remote printer.
Figure 5:
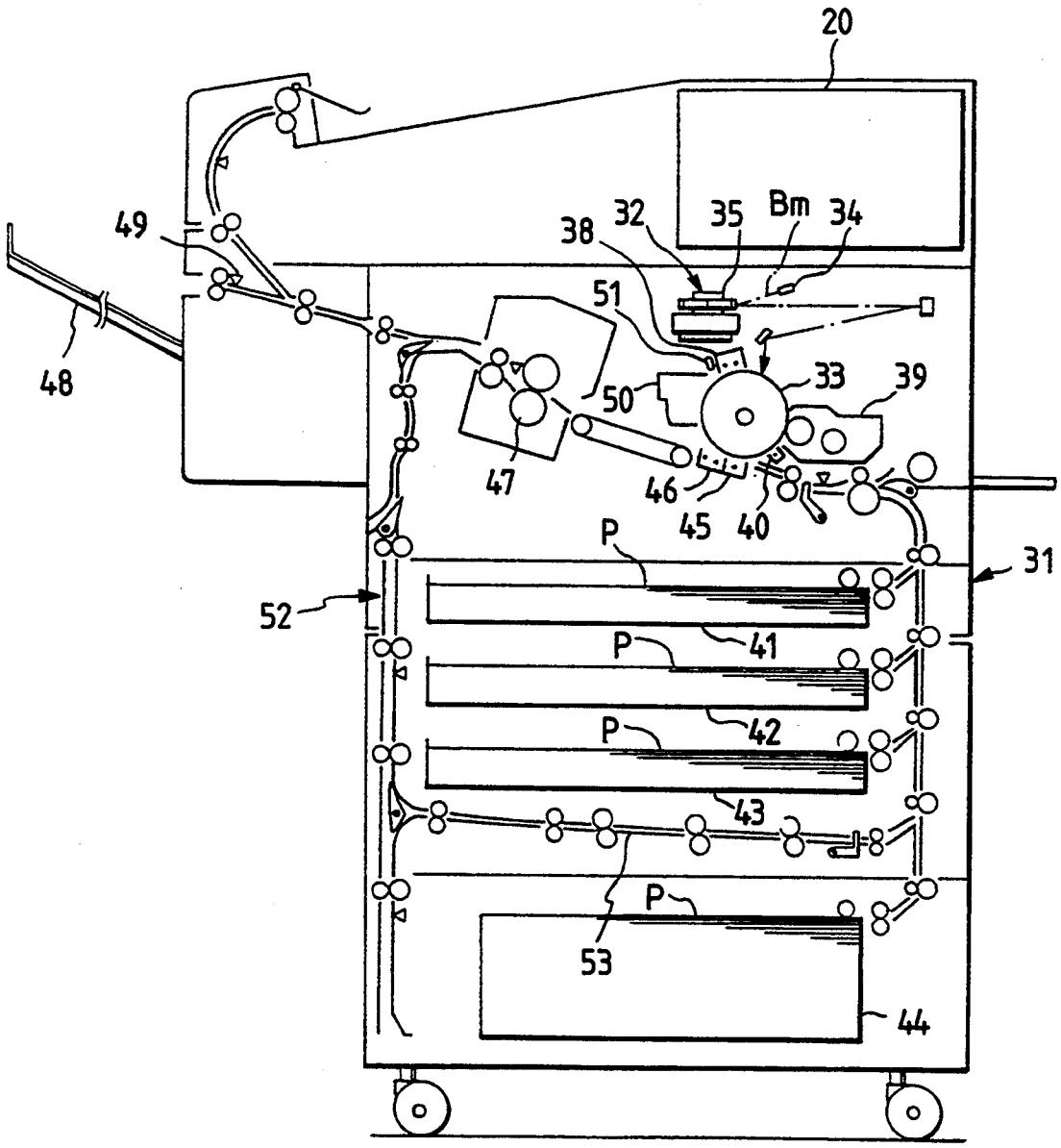
FIG. 5 is an outlined construction of the remote printer.

FIG. 4 shows a remote printer to which an apparatus for detecting a run-out of toner in a developing unit according to the present invention is applied.

Figure 3:
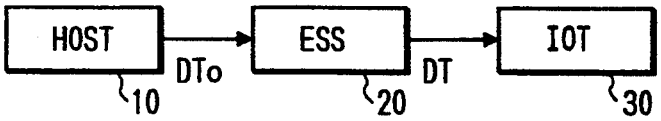
FIG. 3 is a block diagram showing a connection of the remote printer.

This remote printer is, as shown in FIG. 3, provided with an ESS (interface) 20 for converting image data $DT_o$ transferred from a host computer 10 to image data DT before a subsequent transfer and an image output terminal (IOT) 30 for reproducing an image on a recording sheet, not shown, according to the image data DT transferred from the ESS 20.

The ESS 20 is placed in an upper part of a housing 31 of the IOT 30 as shown in FIG. 4. The ESS 20 is equipped with a CRT display 21, a keyboard 22 for selecting and executing various operations of a menu, and a floppy disc unit 23 for picking up the image data stored in advance in a floppy disc not shown.

Next, the configuration of the IOT 30 of the remote printer will be described with printing operation. Precisely, the image data DT transferred from the ESS 20 is converted to an optical signal by a raster output scanner unit 32 (ROS unit) and scanned for exposure onto a photoreceptor drum 33.

The ROS unit 32 scans a laser beam Bm emitted from a semiconductor laser 34 which oscillates in response to the image data DT along the axial direction of the photoreceptor drum 33 by a polygon mirror, 35 to scan for exposure an image in response to the image data DT on the photoreceptor drum 33.

After the photoreceptor drum 33 has been evenly charged in advance to a predetermined potential level by a primary charger 38, the image is scanned for exposure by the ROS unit 32 as described above to form an electrostatic latent image on the surface of the drum 33.

This electrostatic latent image is developed into a toner image by a developing unit 39 for developing with a black toner. After that, the toner image is charged by a pretransfer charger 40 to lower the potential of toner so as to facilitate the transfer.

Subsequently, the toner image formed on the photoreceptor drum 33 is transferred with charge by a transfer charger 45 onto a sheet of recording paper P with a predetermined size supplied from one of a plurality of paper feed cassettes 41, 42, 43 and 44 disposed in the printer body. The sheet of recording paper P onto which the toner image has been transferred is sent to a fusing unit 47 after being separated from the photoreceptor drum 33 with charge by a separation charger 46, thereby the toner image is fused on the sheet of recording paper P.

Thereafter, the sheet of recording paper P with the toner image fused thereon is directly ejected onto an ejection tray 48 in a normal recording mode. The ejection part for the sheet of recording paper P is provided with a paper detection sensor 49 for detecting the sheet of recording paper P.

The surface of the photoreceptor drum 33 is cleaned by a cleaner 50 to remove the remaining toner, paper dust etc. and discharged by an optical irradiation with an erasure lamp 51 to erase a residual charge in order to be ready for subsequent image recording operations.

In other modes for both side recording and one side multiple recording, however, the sheet of recording paper P with the toner image fused thereon is not ejected onto the ejection tray 48 and sent directly or up side down to the image recording part through a conveying passage 52 and an intermediate tray 53, thereby a predetermined toner image is recorded. Only after such transferring and fusing operations of the predetermined image have been repeated, the sheet of recording paper P is ejected onto the ejection tray 48.

FIGS. 6 to 9 respectively show an example of a developing unit to which an apparatus for detecting a run-out of toner according to the present invention is applied.

Figure 6:
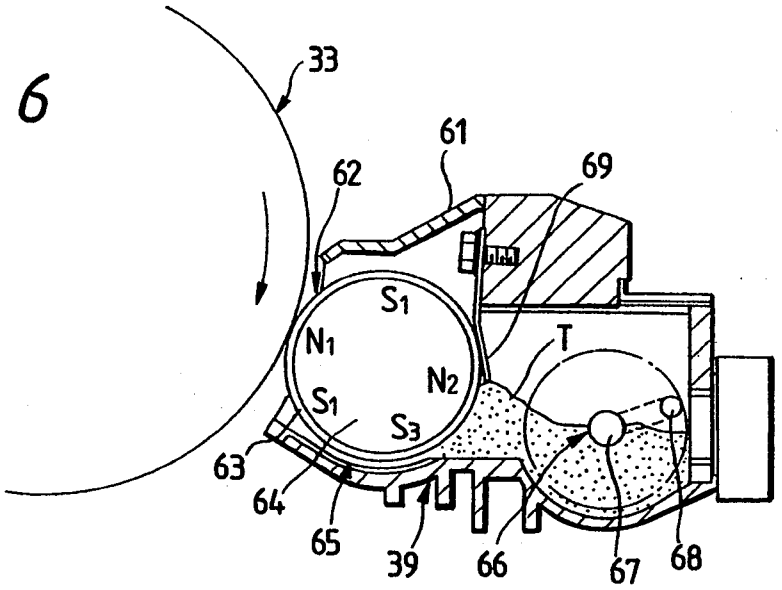
FIG. 6 is a cross sectional view showing the developing unit.

Referring to FIG. 6, there is shown a developing unit 61 which is formed to have a substantially U-shaped cross section and provided with an opening 62 at the photoreceptor drum 33 side of the developer unit 61. A developing roll 65 consisting of a developing sleeve 63 which is rotatably arranged and a magnet roll 64 which is fixedly arranged inside the developing sleeve 63 is provided inside the opening 62 of the developing unit. An agitator 66 which supplies a single component developer made of only toner T while agitating the developer is provided at the rear side of the developing roll 65 in the developing unit 61. This agitator 66 consists of a shaft 67 pivotally supported on the side wall of the developing unit 61 and a coil 68 fixed to the shaft 67. The coil 68 is arranged so that it is fixed to an end of the shaft 67 at its extreme end 68*a*, its central part 68*b* is curved with a large arc along the lengthwise direction of the shaft 67 and its other end 68*c* is spirally formed to carry the toner T, as shown in FIG. 7.

The toner T in the developing unit 61 is supplied to the developing roll 65 by the agitator 66 as shown in FIG. 6. This toner T is attracted by means of a magnetic force of the magnet roll 64 provided inside the developing roll 65 and moved along with rotation of the developing sleeve 63. In this case, the toner T is supplied so that its thickness is controlled by a trimmer blade 69 which is protruded downwardly from the ceiling of the developing Unit 61 and that the toner T is applied in the same thickness onto the surface of the developing sleeve 63. The toner T applied onto the developing sleeve 63 is conveyed to a position nearby the photoreceptor drum 33. Then, an electrostatic latent image formed on the photoreceptor drum 33 is developed by applying a predetermined developing bias to the developing sleeve 63.

Figure 7:
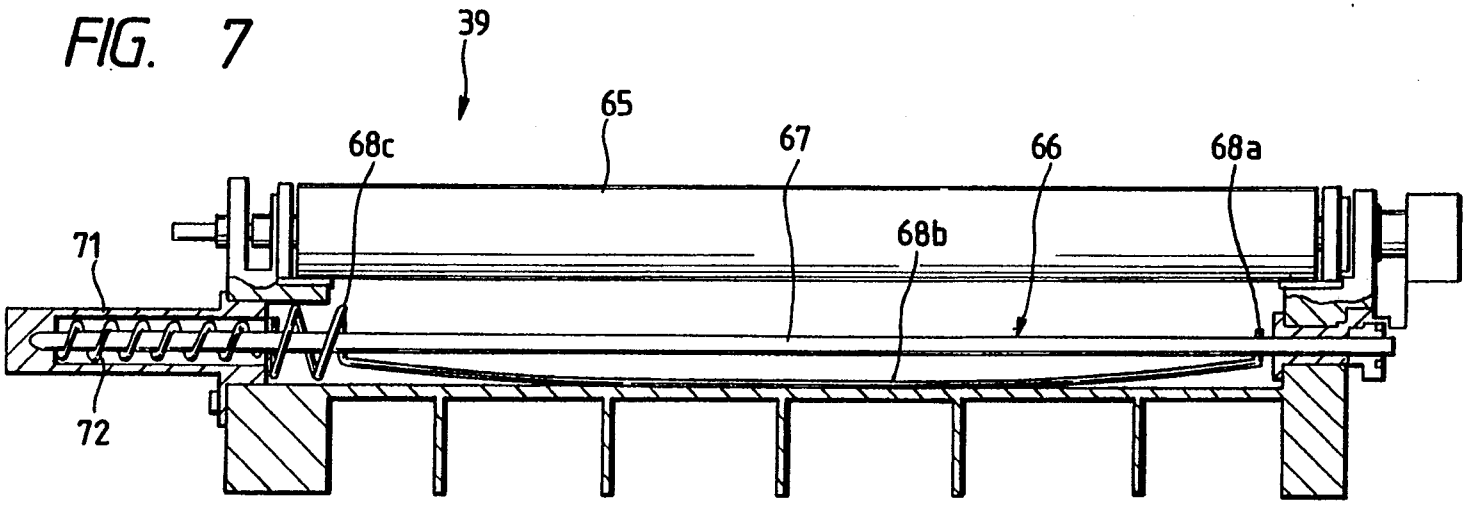
FIG. 7 is a horizontal cross sectional view showing the developing unit.

An auger pipe 71 for supplying the toner T from a toner supplying part 74, which will be described later, is provided to be protruded from a side wall of the developing unit 61 as shown in FIG. 7 and an auger 72 is rotatably provided inside the auger pipe 71. The auger 72 partly shares the agitator 66 in a construction that a strip member is spirally wound in a diameter smaller than the diameter of the coil 68 around the shaft 67 of the agitator 66.

Figure 8:
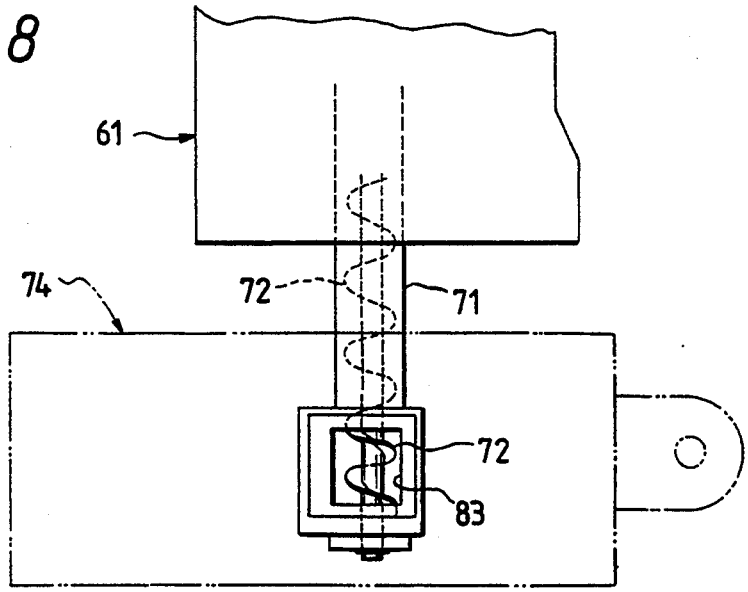
FIG. 8 is an explanatory plan view showing a relationship between the developing unit and the toner supplying part.
Figure 9:
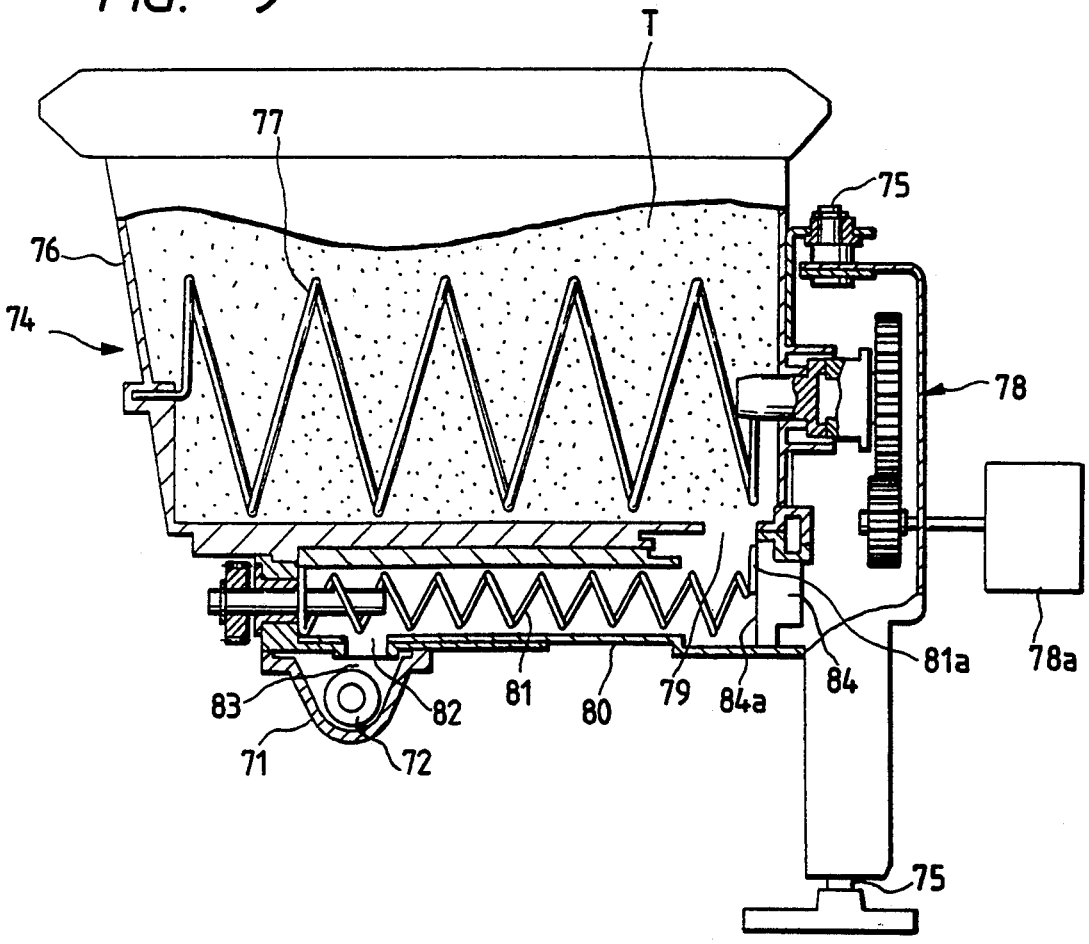
FIG. 9 is a vertical sectional view showing the toner supplying part.

On the other hand, the toner supplying part 74 for supplying the toner T into the developing unit 61 is provided on a side of the developing unit 61 as shown in FIG. 8 and adapted to be turnable in a horizontal plane by means of a pivot 75 provided at its one end as shown in FIG. 9.

Referring to FIG. 9, there is shown a toner container 76 which is box-shaped to internally store the toner and made as a cartridge type which is detachable or remountable on the toner supplying part 74. Therefore the toner T can be easily replenished by replacing an empty toner container 76 with a new toner container 76. A coil type agitator 77 is rotatably provided in the toner container 76 as agitating means for preventing blocking and other abnormal conditions of the toner T by agitating the toner stored in the toner container 76 at predetermined timing. A driving force for the agitator 77 is supplied from a driving system 78 of the toner supplying part 74 which is coupled with one end of the agitator 77 by installing the toner container 76 on the toner supplying part 74. This drive system is driven by a dispense motor 78*a*.

The toner container 76 is provided, at an end of its bottom, with an opening 79 for guiding out the toner T and a tubular guide 80 with a U-shaped cross section, which communicates with the opening 79 as shown in FIG. 9. An auger 81 for carrying the toner T supplied from the opening 79 of the toner container 76 is rotatably provided inside the tubular guide 80. The toner T carried by this auger 81 is supplied to an opening 83 of the auger pipe 71 which is protruded out of the developing unit 61 through a supplying port 82 provided at the other end bottom of the tubular guide 80 as shown in FIG. 9. The toner T supplied into the opening 83 is carried into the inside of the developing unit 61 by the auger 72 as described above.

In this embodiment, a toner run-out detection sensor 84 consisting of a piezoelectric element for detecting the presence or absence of toner T is provided in the toner supplying part 74. This toner run-out detection sensor 84 is fitted to the end side wall of the tubular guide 80 located below the opening 79 of the toner container 76 and arranged so that its circular detection surface 84*a* is integral with the end side wall of the tubular guide 80. The presence or absence of toner T is detected by checking an oscillation of the piezoelectric element which differs with whether or not the toner T comes in contact with the detection surface 84*a* of the toner run-out detection sensor 84. A sensor surface cleaning member 81*a* which comes in contact with the detection surface 84*a* of the toner run-out detection sensor 84 is provided at the extreme end of the auger 81 so that the detection surface 84*a* of the sensor is cleaned as the auger 81 rotates.

Further, in this embodiment, the toner run-out detection means is provided with counting means for counting the toner run-out state by accumulating the number of image recorded-sheets and the number of image signals which are under detection and control means for stopping at least the operation of the image recording unit when the count value of the image-recorded sheets by this counting means reaches a predetermined value. When the toner run-out detection means detects the toner run-out state, the number of image recorded sheets is counted by counting means through accumulation.

Figure 2:
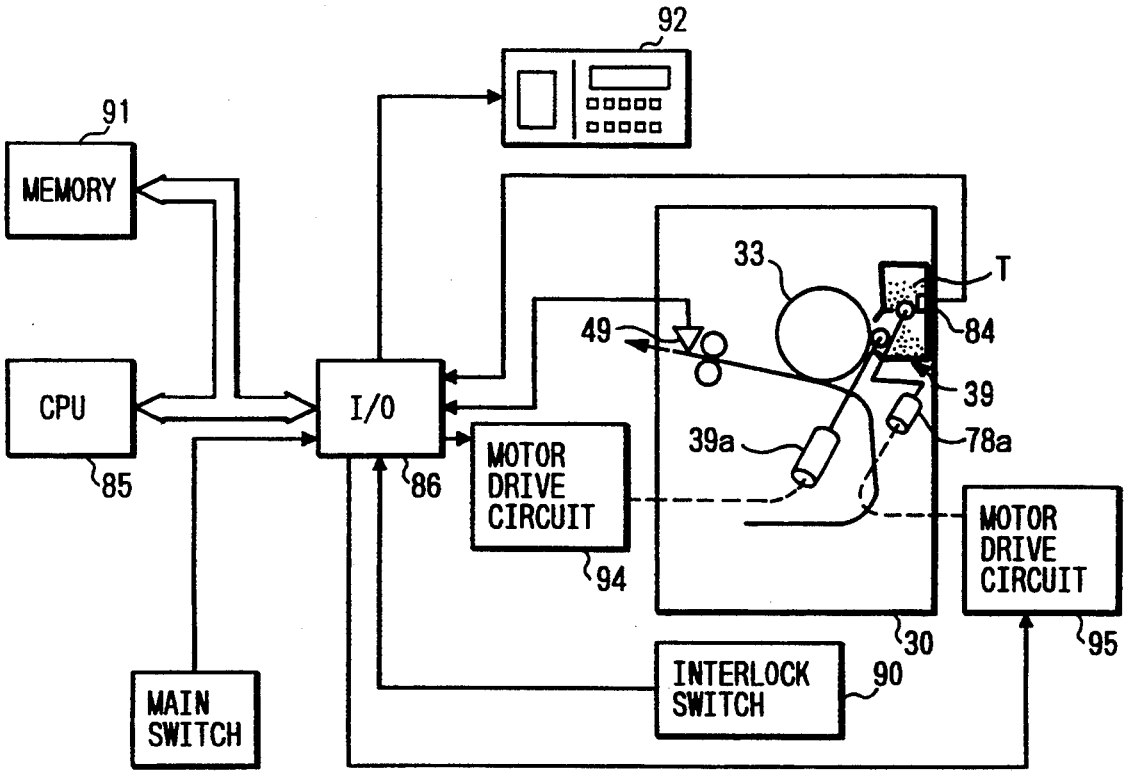
FIG. 2 is a block diagram showing an example of the toner run-out detecting apparatus for a developing unit.

FIG. 2 is a block diagram showing the control circuit of the toner run-out detection apparatus according to this embodiment.

In FIG. 2, there is shown a CPU 85 which serves as counting means and control means and controls the operation of the whole remote printer.

An output signal from the toner run-out detection sensor 84 and an output signal from the paper detection sensor 49 are respectively entered into the CPU 85 through an I/O port 86.

In addition, the CPU 85 receives a signal from an interlock switch 90 which detects opening or closing of a cover, not shown, of the printer which is operable for replacing the toner container 76 of the developing unit 39 through the I/O port 86.

A non-volatile memory 91 serves to store a value of counts and the like. Further, a control panel 92 serves to display the toner run-out state in the developing unit 39.

A motor drive circuit 94 serves to drive a developing unit drive motor 39*a* and a motor drive circuit 95 serves to drive the dispense motor 78*a*. These circuits are controlled by the CPU 85 through the I/O port 86.

Figure 1:
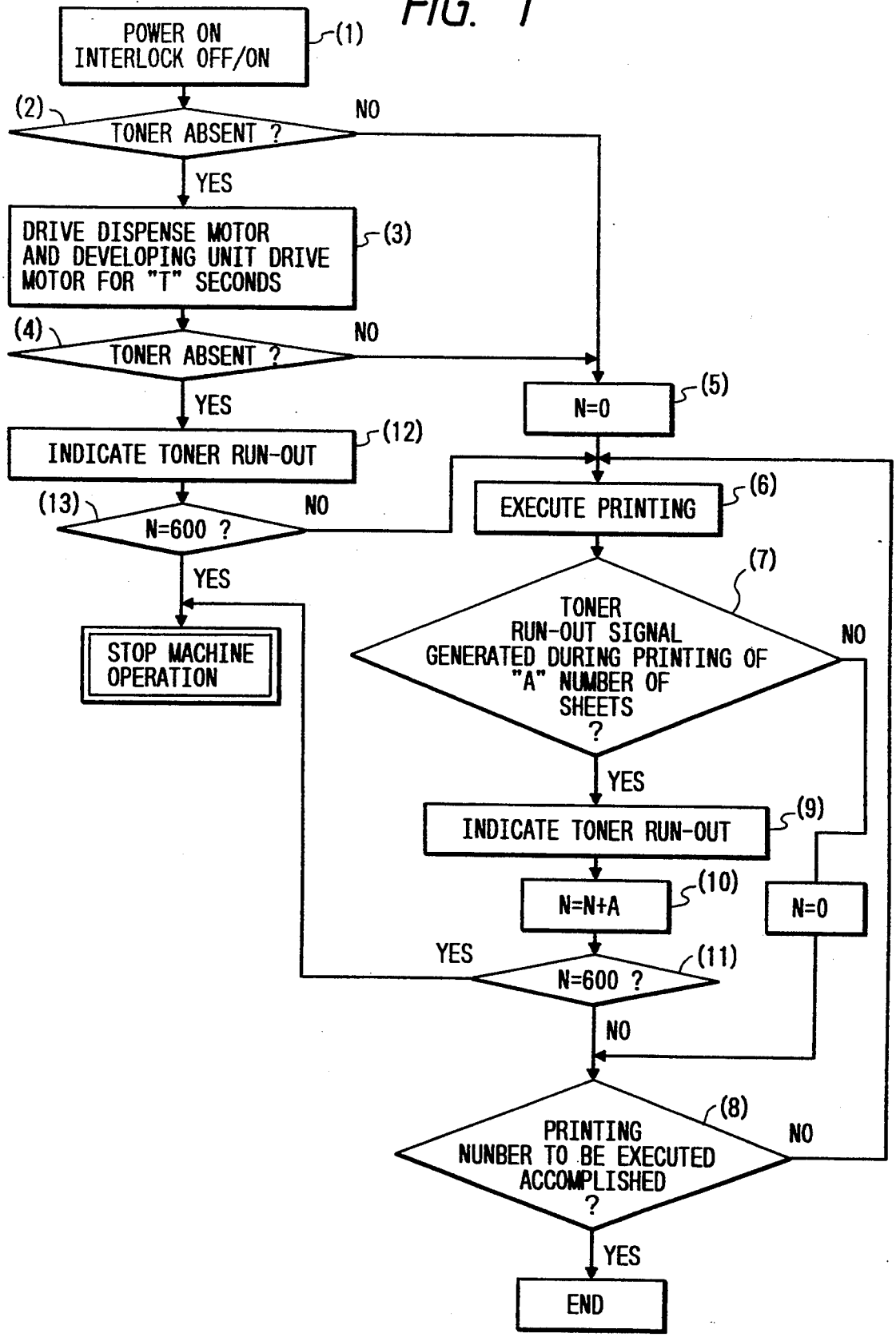
FIG. 1 is a flowchart showing a procedure for detecting a run-out of toner by an embodiment of the apparatus according to the present invention.

Detection and control operation of the run-out of toner in the developing unit according to the above construction will be described hereinafter with reference to FIG. 1.

The main switch of the machine for power is turned on (step 1). In this case, since the covers such as the front cover of the machine, which are operable for replacing the toner cartridge, are kept closed and the interlock switch 90 is kept on, the toner run-out detection sensor 84 functions to detect the presence or absence of the toner in the toner supplying part 74 (step 2).

When the toner run-out signal is output, both motor drive circuits 94 and 95 are turned on and the developing unit drive motor 39*a* and the dispense motor 78*a* are driven for a predetermined period of time, e.g., T seconds (step 3).

Next, the presence or absence of the toner is detected again (step 4).

In step 3 where the toner is blocked in the toner container 76 and is not dropped into the opening 79 of the toner container 76 despite there still remains the toner in the toner container 76, the toner which has been blocked is unblocked by the agitator 77 and dropped into the opening 79. In this case, the operation proceeds to "NO" in step 4.

If the toner container 76 remains empty from the beginning, the operation proceeds to "YES" (toner run-out) in step 4.

The count value N indicting the number of printed sheets is set to 0 (N=0) after the toner run-out is detected with "NO" signal in step 4, and the machine is initialized and released from being halted (step 5).

Printing is executed through step 5 (step 6). During execution of this printing, the toner run-out detection sensor 84 detects the presence or absence of the toner once each time the number A of sampling sheets, for example, ten sheets are printed (step 7).

If the toner run-out is not detected even once during the counting of the number of sampling sheets, the printing is continued up to a predetermined number of sheets and the number of printed sheets is compared with a designated printing number to be executed (step 8). When the printing number to be executed is accomplished, the printing is finished.

If the toner run-out is detected (Yes) in step 7 during execution of the printing, the toner run-out is indicated (step 9). Thus, the number A of printed sampling sheets is added to N (step 10). This operation is carried out until the number of sampling sheets reaches a predetermined number, for example, 600 sheets. In this case, when N=600 (step 11), the machine operation is stopped and the machine halts.

If a signal indicating that there is still the toner is detected in step 2, the operation proceeds to step 5 without executing steps 3 and 4.

Next, the operation in the case where the toner run-out is detected in step 4 will be described. In this case, the toner container 76 remains empty from the beginning and the toner run-out is indicated (step 12). Following step 12, whether the value N for the machine has reached 600 sheets is checked (step 13). The value N denotes the number of printed sheets after the toner run-out is detected by the toner run-out detection sensor 84. Since it is presumed, from the fact that the toner run-out was detected in step 2 in the current printing operation, that the toner run-out was already detected in step 9 in the preceding printing operation and the value N is smaller than 600, step 6 and the following steps are executed to continue printing until the value N reaches 600.

In case N>600 in step 13, the machine operation is stopped.

In the above operations, the toner is replenished in step 9, step 12 or when the machine halts.

As described above, according to the present invention, in the developing unit of the image recording equipment which forms an electrostatic latent image on a latent image carrier by exposure in response to the image signals and develops the electrostatic latent image into a toner image to be recorded, the presence or absence of the toner is detected under the condition that the power is turned on and the interlock is released, and the presence or absence of the toner is detected again after operating the developing unit and the toner supplying mechanism for a predetermined time when the toner run-out is detected. Thus, the present invention allows to supply the toner in a normal condition by unblocking the toner which has been blocked and prevented from being dropped despite there is still the toner in the toner supplying mechanism, enabling to eliminate a trouble in supplying the toner. In addition, the toner can be normally and certainly supplied from a new toner cartridge even though it is not shaked before installation.

Since the above developing unit is adapted to detect the presence or absence of the toner under the condition that the power is turned on and the interlock is released and the copying machine is initialized, while it is detected that there is still the toner, to release the machine from being halted, the machine, which has been halted due to detection of the toner run-out, can be released only by a supplying operation of the toner when a new toner cartridge is mounted and the operational efficiency can thus be improved.

Moreover, since the developing unit is adapted to detect the presence or absence of the toner each time a plurality of sheets are printed during execution of the printing and to determine the run-out of the toner if the toner run-out is detected once, a faulty indication due to the cleaning member of the toner run-out detection sensor can be prevented and the machine can be certainly halted after the predetermined number of sheets are printed after the run-out of the toner is detected.

What is claimed is:

1. A toner supplying apparatus comprising:

a developing unit;

guide means for supplying toner to the developing unit, said guide means containing detecting means for detecting a presence or absence of toner and toner conveying means for conveying toner to the developing unit; and a toner cartridge mounted on said guide means, said toner cartridge having toner dispensing means for dispensing toner to said guide means;

said guide means being elongated and having one end portion including a first opening opposite the toner dispensing means of the toner cartridge and the other end portion including a second opening opposite the developing unit; said toner conveying means conveying toner from the first opening to the second opening; and said detecting means being disposed at said one end portion in proximity to the first opening.

2. The toner supplying apparatus of claim 1 wherein said detecting means includes a piezoelectric element.

3. The toner supplier apparatus of claim 1 wherein the developing unit includes a main body and a toner guide member having a third opening provided opposite the second opening.

4. The toner supplying apparatus of claim 1, wherein said detecting means is fitted to a side wall right under the first opening.

5. The toner supplying apparatus of claim 1, wherein said detecting means is provided at an end of said toner conveying means on the side of the first opening (on the opposite side to the toner conveying direction).

6. The toner supplying apparatus of claim 1, wherein an end of said toner conveying means has a cleaning member for said detecting means, said cleaning member coming in contact with said detecting means.

7. An image forming device comprising:

a developing unit;

guide means for supplying toner to the developing unit, said guide means containing detecting means for detecting a presence or absence of toner and toner conveying means for conveying toner to the developing unit;

a toner cartridge mounted on said guide means, said toner cartridge having toner dispensing means for dispensing toner to said guide means;

said detecting means detecting a presence or absence of toner in said guide means according to the state of a power-on signal of the image forming device and the state of an interlock signal of the image forming device;

means for driving said dispensing means for a predetermined period of time after an absence of toner is first detected until a presence or absence of toner is again detected in said guide means;

means for outputting a toner exhaustion signal when an absence of toner is detected a second time;

means for accumulating a number of prints after the toner exhaustion signal is outputted; and means for shutting down the image forming device when the accumulated number of prints exceeds a predetermined value.

8. An apparatus for detecting and controlling the exhaustion of toner in a toner supplying apparatus in an image forming device, the toner supplying apparatus having a developing unit, guide means for supplying toner to the developing unit, toner conveying means for conveying toner to the developing unit, a toner cartridge mounted on said guide means, and said toner cartridge having toner dispensing means for dispensing toner to said guide means, said detecting and controlling apparatus comprising:

detecting means for detecting a presence or absence of toner in the guide means;

said detecting means detecting a presence or absence of toner in said guide means according to the state of a power-on signal of the image forming device and the state of an interlock signal of the image forming device;

means for driving said dispensing means for a predetermined period of time after an absence of toner is first detected until a presence or absence of toner is again detected in said guide means;

means for outputting a toner exhaustion signal when an absence of toner is detected a second time;

means for accumulating a number of prints after the toner exhaustion signal is outputted; and means for shutting down the image forming device when the accumulated number of prints exceeds a predetermined value.

9. The detecting and controlling apparatus of claim 8 wherein said detecting means includes a piezoelectric element.

10. An apparatus for detecting and controlling the exhaustion of toner in a toner supplying apparatus in an image forming device, the toner supplying apparatus having a developing unit, guide means for supplying toner to the developing unit, toner conveying means for conveying toner to the developing unit, a toner cartridge mounted on said guide means, and said toner cartridge having toner dispensing means for dispensing toner to said guide means, said detecting and controlling apparatus comprising:

detecting means for detecting a presence or absence of toner in the guide means;

said detecting means detecting a presence or absence of toner in said guide means each time the number of prints is equal to a predetermined number;

means for counting the number of prints;

means for accumulating the number of prints after a toner exhaustion signal is generated; and means for shutting down the image forming device when the accumulated number of prints exceeds a predetermined value.

* * * * *